US006845877B2

(12) United States Patent
Diesterbeck

(10) Patent No.: US 6,845,877 B2
(45) Date of Patent: Jan. 25, 2005

(54) PLASTIC CONTAINER WITH SNAP LID AND A SEALING WEB LOCATED ON THE INSIDE OF THE CONTAINER

(75) Inventor: Frank Diesterbeck, Marienheide (DE)

(73) Assignee: Jokey Plastik Gummersbach GmbH, Gummersbach (DE)

( * ) Notice: Subject to any disclaimer, the term of this patent is extended or adjusted under 35 U.S.C. 154(b) by 0 days.

(21) Appl. No.: 09/822,850

(22) Filed: Apr. 2, 2001

(65) Prior Publication Data

US 2002/0175172 A1 Nov. 28, 2002

(30) Foreign Application Priority Data

Apr. 1, 2001 (DE) ..... 200 06 095 U

(51) Int. Cl.[7] ..... B65D 41/16

(52) U.S. Cl. ..... 220/782; 220/792; 220/795; 220/659; 215/DIG. 1; 206/508

(58) Field of Search ..... 220/380, 780, 220/782–784, 787, 789, 790, 792, 795, 656–659; 206/508, 515; 215/DIG. 1

(56) References Cited

U.S. PATENT DOCUMENTS

| | | | | | |
|---|---|---|---|---|---|
| 3,510,023 | A | * | 5/1970 | Ullman et al. | 220/320 |
| 3,696,962 | A | * | 10/1972 | Fehres et al. | 156/148 |
| 5,035,344 | A | * | 7/1991 | Christopher | 215/236 |
| 5,143,219 | A | | 9/1992 | Yates, Jr. | |
| 5,540,349 | A | * | 7/1996 | Philips | 206/508 |
| 5,810,190 | A | * | 9/1998 | Welch | 215/251 |
| 5,915,575 | A | * | 6/1999 | Morris, Sr. | 206/508 |
| 6,006,942 | A | * | 12/1999 | Morris et al. | 206/508 |
| 6,325,226 | B1 | * | 12/2001 | Krautkramer | 215/252 |

FOREIGN PATENT DOCUMENTS

| | | |
|---|---|---|
| DE | 30 32 366 | 4/1982 |
| DE | 81 31 915 | 4/1982 |
| DE | 31 08 949 | 7/1982 |
| DE | 84 29 165 | 1/1985 |
| DE | 43 06 982 | 8/1998 |
| EP | 0 600 127 | 12/1992 |
| EP | 0 746 510 | 8/1997 |
| FR | 90 10292 | 8/1990 |
| GB | 1430983 | 4/1976 |
| WO | WO 96/16875 | 6/1996 |

OTHER PUBLICATIONS

Abstract for WO 00/32490.

* cited by examiner

*Primary Examiner*—Robin A Hylton
(74) *Attorney, Agent, or Firm*—Browdy and Neimark, P.L.L.C.

(57) ABSTRACT

A plastic container with a snap lid and with a snap element is provided on the upper edge region of the container for the lid to snap onto, where the lid has a circumferential sealing web projecting downwards that contacts the inside of the container, where at least one projection that extends in an essentially radial and essentially vertical direction is provided on the lid radially inside the sealing web. To provide a plastic container with snap lid, which fulfils the special demands imposed on leak-proofness, while simultaneously providing high load-bearing capacity, the vertical extension of the area of the projection adjacent to the sealing web is small relative to the total vertical extension of the projection. The inward-facing projection can be located on an inside circumferential edge integrally molded on the sealing web. In addition to the sealing web, another circumferential seal is provided in the region of the top edge of the container.

22 Claims, 9 Drawing Sheets

PLASTIC CONTAINER WITH SNAP LID AND A SEALING WEB LOCATED ON THE INSIDE OF THE CONTAINER

BACKGROUND OF THE INVENTION

1. Technical Field

The invention relates to a plastic container with a snap lid, the container having an upper edge region, an inside and a snap element provided on the upper edge region of the container for the lid to snap onto, where the lid has a circumferential sealing web projecting downwards that contacts the inside of the container, where at least one projection that extends in an essentially radial and essentially vertical direction is provided on the lid radially inside the sealing web.

2. Prior Art

Plastic containers of this kind are used to transport various goods, particularly also in the industrial and food sectors, and have often proven to be effective for this purpose. However, transporting liquids or low-viscosity materials still involves the problem of the sufficient leak-proofness of the plastic containers. This is particularly the case when transporting volatile or other types of critical goods, such as oils, particularly mineral oils. In these cases, especially high demands must be imposed on the leak-proofness of the plastic container, which have not yet been fulfilled satisfactorily by previously known plastic containers, even though numerous attempts have been made to achieve sufficient leak-proofness by providing the container edge and the lid with a corresponding profile.

In order to increase the stiffness of the horizontal lid area, it is commonly known that projections can be provided that extend from the circumferential, inner lid edge towards the main axis of the container, i.e. the longitudinal axis of the container running through the container's center of gravity. If necessary, these projections, or a circumferential lid edge running around the inside of the container, are provided on the inside with reinforcing ribs that rest on the inside sealing web. However, it has become apparent that this design does not always make it possible to achieve reliable leak-proofness of the container. This is particularly true when the side walls of the projections or reinforcing ribs, e.g. annular or box-shaped projections, exceed a certain thickness for high loads.

An object of the invention is to provide a plastic container with snap lid, which fulfills the special demands imposed on leak-proofness, while simultaneously providing high load-bearing capacity.

OBJECT AND SUMMARY OF THE INVENTION

The object is solved by a plastic container with snap lid, in which the vertical extension of the area of the projection immediately adjacent to the sealing web is small relative to the total vertical extension of the projection. In this context, the projection can be designed in the shape of a web or with spaced-apart side walls. It can also be designed as a reinforcing rib of a projection and/or of an inside circumferential edge. The rib can be designed as an outside rib extending outward from the lid, preferably as an inside rib extending from the lid towards the inside of the container. The radially inward, adjacent wall section can, for example, form the radially inward bordering wall of a box-shaped projection or an inner, circumferential edge. The vertical extension of the sections integrally moulded on the sealing web can, for example, thus be small relative to the height of the projections or the height of the inside ribs or side walls of the side facing the inside of the container. Thus, if the height of the inside ribs is substantially smaller than the height of the projections, the inside ribs can essentially be of uniform height. Preferably, however, the height of the inside ribs on the side facing away from the container wall corresponds to that of the projections, for example, meaning that the height of the inside ribs decreases radially towards the outside. The overall height of the projection corresponds to the height of the projection over the radial extension of the same.

The vertical extension of the sections of the projections integrally moulded on the sealing web is thus also small relative to the height of the sealing web itself, particularly relative to its height extending below the integrally moulded element. The height of the integrally moulded element can be less than ¾, e.g. less than ½ or less than ¼, the height of the sealing web and roughly as thick as the lid wall, for example.

As a result of the fact that the height of the areas of the projection adjacent the sealing web are designed as walls, e.g. as inside ribs or side walls, integrally moulded on the sealing web, or facing it, is relatively small, the sealing web can be moulded with great accuracy and reproducibility, where changes in the material and/or shape in the region of the sealing web, e.g. due to bonding flaws, material shrinkage and the like, are reduced to a minimum. It has been found that material stresses caused by the integrally moulded vertical ribs or side walls can extend vertically beyond the integrally moulded areas and possibly even into the sealing region of the web. As a result of the measure according to the invention, the integrally moulded projection can be spaced apart from the area of the sealing web that provides the greatest degree of leak-proofness, so that this sealing region is essentially free of the effects of the integrally moulded projection. Due to the measure according to the invention, the sealing web thus rests very uniformly against the inside wall of the container over the entire circumference, even when the inside ribs or side walls of the projections are very thick, thus providing high leak-proofness of the container.

The height of the projections, such as the inside ribs or side walls, on the side facing the container wall can be less than ¾, e.g. ½ or ¼, the height facing the center of the container, the total height or the vertical extension of the radially inward wall section that is essentially perpendicular to the projection. Preferably, the inside ribs or side walls only contact the sealing web in punctiform fashion. If the projection is integrally moulded right on the sealing web, the vertical distance between the bottom edge of the projection adjacent to the sealing web and the sealing region of the sealing web (particularly the region providing the greatest sealing effect) can be ¼ to ½ or more of the height of the projection. In this context, the sealing region, particularly the region providing the greatest sealing effect, can be at the height of the projection, e.g. of a reinforcing rib or a side wall of a projection, e.g. if the bottom edge of the projection slopes down towards the inside of the container or the projection is spaced apart from the sealing web.

According to a particularly preferred configuration, at least one projection, or the side walls or inside ribs of the same, is spaced radially apart from the sealing web located on the inside of the container, meaning that material stresses resulting from the non-uniform distribution of material accumulations around the peripheral edge of the container are not transmitted directly to the sealing web. Thus, if annular or box-shaped (e.g. cubic or prismatic) projections are provided, for example, only the upper and radially inward sides of the side walls or inside ribs of the projections are connected to the lid. This measure was found to make it possible to achieve sufficient stability of the projections, without having a detrimental effect on the sealing web. If appropriate, the inside ribs can also support the inner, essentially horizontal lid area and be integrally moulded on the underside of the lid.

The sealing web can have a linear or planar area of contact with the inside wall of the container. In this context, the sealing contact area of the sealing web, which preferably has an oblong cross-section, is preferably provided below the areas of the lid integrally moulded on the sealing web, such as the inside ribs or side walls of the projections, particularly preferably in the region of or on the lower free end of the sealing web. In this way, the contact area can have a certain degree of flexibility, which is frequently no longer provided to a sufficient degree when, for example, the inside surface of the lid or the top of projections is integrally moulded on the lower region of the sealing web, thus restricting the flexibility of the sealing web and, for example, additionally transmitting the forces absorbed by the projections when containers are stacked on top of one another to the lower region of the sealing web, thereby possibly impairing its sealing function. The contact area in tight contact with the inside wall of the container can extend over a multiple of the lid wall thickness, e.g. roughly 4 times the same, without being restricted to this.

The sealing web advantageously extends from the integrally moulded lid areas, which extend radially inward towards the inside of the lid, over a vertical height that corresponds to a multiple of the lid wall thickness, preferably 2 to 5 times the lid wall thickness or more. The sealing web is preferably free of radially extending, integrally moulded elements over this height. The wall thickness of the sealing web can be in the region of 0.5 to 1.5 times the lid wall thickness, e.g. roughly equal to it.

The sealing region of the sealing web, e.g. the lower end of the same, is preferably in the region of the vertical height of the lid projections, e.g. in the region of half that height or the bottom third of the projections.

The cross-section of the projections can be triangular or rectangular, for example, possibly also skew, where the top and/or bottom edge of the side walls of the projections, or the inside ribs, slope down towards the inside of the container (preferably at an angle of <15°, e.g. approximately 5°) or are horizontal. The radially inward end wall of the projections or inside ribs can be vertical or angled.

According to an advantageous configuration, at least one projection can be integrally moulded on the top side of an area extending radially inwards from the sealing web and sloping down towards the inside of the container. In this context, the projection can be of web or box-shaped design.

A circumferential edge, on which the projections protruding towards the inside of the container are integrally moulded radially inwards, is preferably integrally moulded on the inside of the sealing web. The edge can slope down towards the inside of the container or be essentially horizontal, without being restricted to this. The circumferential edge preferably extends in the radial direction over one or more times the wall thickness of the same, e.g. over approximately 2 to 3 times the wall thickness, starting from the inside of the sealing web. When looking at the lid from below, a circumferential groove with, for example, a roughly trapezoidal or triangular cross-section and inwardly facing wider areas results. The inside ribs or side walls of the projections are thus spaced apart from the sealing web or the top edge of the lid in the radial direction. This provides great stiffness of the inside area of the lid, e.g. for the purpose of stacking containers, while preserving the high leak-proofness of the container.

The inside reinforcing ribs can be provided on several separate projections, such as essentially box-shaped projections, and also on an annular, circumferential projection that forms a trough-shaped lid edge.

The projections can be integrally moulded on the top edge of the lid. The top edge of the projections is preferably spaced away from or below the sealing region of the top edge of the lid, thus creating another shoulder. This avoids integral moulding at the height of the sealing region on the inside of the container, which can lead to material stresses or deformation, e.g. due to shrinkage processes. If the sealing region on the top edge of the container extends over a vertical area, the top side of the projections can also be located roughly level with the bottom end of the sealing region. This applies both when the sealing region is formed by direct contact surfaces between the lid and bucket, and when a flexible seal is provided.

An indentation is preferably formed in the container wall directly below the sealing web when the lid is in place. When the lid is in place, the sealing web can rest on the indentation, or also be spaced away from it such that the underside of the web rests on the container indentation when additional containers are stacked on top or when an external force is applied. The shoulder in the inside wall of the container, which is located below the sealing web of the lid, can be located roughly at the height of the snap element or a reinforcing rib, or at a distance of one or a few times the container wall thickness.

In order to increase the reliability of the container seal, an area projecting upwards beyond the bottom edge of the sealing web can be provided on the inside wall of the container, which is radially inward relative to the circumferential sealing web. This area is preferably integrally moulded on the inside container shoulder. To this end, individual projections or webs can be provided that are spread around the circumference. This area is preferably also designed as a circumferential rib. The height of this rib, which prevents inward shifting of the sealing web of the lid, is preferably smaller than the wall thickness of the container or the sealing web, without being restricted to this. The upwardly projecting areas of the container can be slightly spaced apart or contact the side of the sealing web of the lid with or without pretension. In this context, the sealing web of the lid can also be located in a press fit between the radially adjacent inside and outside container areas.

Another sealing region between the container and the lid is preferably located in the region of the top edge of the container. The sealing region can have a seal made of a material of greater elasticity than that of the lid and the bucket, particularly a rubber material. The seal can be integrally moulded on one of the parts, thus avoiding positional tolerances and ensuring that the seal always located on the component in unmoveable fashion, even when exposed to forces, e.g. if containers fall. The seal is preferably integrally moulded by an injection process, e.g. injection moulding, so that joints or the like are avoided. The seal can also be mounted merely in non-positive or positive fashion, e.g. inserted in an annular groove. The sealing region in the region of the top edge of the container can also be formed directly by contact areas of the lid and bucket.

The seal is advantageously integrally moulded on the lid, where the width of the seal can be greater than the wall thickness of the top edge of the container. The seal can have an essentially horizontal sealing region. One, two or even more different sealing regions can be provided that can differ in terms of their contact width, material thickness or other characteristics. The sealing regions can be interconnected or radially or axially separated from one another.

The seal preferably has two, adjacent sealing regions that are at different angles and tightly contact areas of the container edge at different angles. To this end, the seal can have a U, V or L-shaped cross-section, in particular, or other profiles, where the sealing regions can be arranged on opposite areas of the seal, possibly also in a convex area, for example.

The seal is advantageously located in a circumferential groove in the lid that surrounds the container edge, where the seal can extend over the entire width of the groove and is thus further secured against lateral shifting. The sealing web on the inside of the container can be designed as an extension of the inside flank of the groove.

When the container is closed, the seal preferably has an essentially horizontal area that tightly contacts the top edge of the container and a radially inward area that preferably slopes downwards and tightly contacts the inside of the upper container edge. The downward sloping sealing region can extend essentially vertically or at an angle when the container is in upright position, where the two sealing regions can enclose an angle of 90° to 135° or more. The container edge preferably likewise has a horizontal sealing region and a radially inward bevel or chamfer for positioning the vertical or angled sealing region. As a result, forces are always absorbed in the region of the flexible seal, even forces acting laterally on the sealing region, so that a high degree of leak-proofness is ensured.

The seal can have one or more circumferential sealing webs projecting towards the container edge, which tightly contact an area of the container, particularly the top edge of the container. The container edge can be plane or provided with one or more circumferential ribs, pairs of which can form a groove that is at least partially engaged by one or more sealing webs. The structures of the seal and the container edge that come into contact can also be incompatible, so that elevations on the seal do not lie opposite depressions in the container edge, but rather contact elevations on the container edge, e.g. in the flank area of the same. This results in non-congruent interlocking that ensures high and reliable leak-proofness. In this context, the height of the sealing webs is preferably smaller than the container wall thickness, e.g. ½ or ⅕ of the same or less, without being restricted to this.

The above descriptions of the geometry of the seal, the design of sealing webs, etc., also apply accordingly to a sealing region integrally moulded on the lid and the container, i.e. where areas on the lid and the container come into direct contact with one another.

Webs projecting radially outward, which can be designed as circumferential ribs whose radial extension is less than the container wall thickness, can be integrally moulded on the outwardly downward-sloping area of the outer container wall adjacent to the top edge of the container. These ribs can be made of the same material as the container wall and essentially serve to reduce the friction when putting on the lid, where they only have a secondary sealing function. Two or more vertically spaced, circumferential ribs can also be provided. When the lid is in place, the ribs preferably make contact without play, but also without any significant pretension, so that the lid is precisely positioned in the sealing region of the top edge of the container, or are spaced apart with slight play, without being restricted to this.

In order to stabilise the sealing region, one or more radially projecting reinforcing rib(s) is or are integrally moulded, preferably on the outside, on the container edge on the side of the snap element facing towards and/or away from the top edge of the container. The reinforcing rib preferably runs radially around the container. It can also be divided and consist of several reinforcing segments. One or more reinforcing ribs can also be integrally moulded on each of the sides of the snap element facing towards and away from the top edge of the container. The thickness, i.e. height and/or width, of the reinforcing rib can be in the region of the wall thickness of the container or greater. Arranging the reinforcing rib adjacent to the flexible seal makes the sealing region in the region of the top edge of the container particularly stable. The lid preferably contacts the radially outer side of the reinforcing rib with or without pretension, so that forces acting on the side of the lid are absorbed directly by the reinforcing rib. For this purpose, the radially outer side of the reinforcing rib can have a plane area. The space between the reinforcing rib and the snap element can be designed to accommodate the snap edge of the lid. If the reinforcing ribs are located directly on the container wall, forces exerted on the container wall by the inner sealing web are also absorbed. The same applies to the snap edge, if it is of adequate stiffness.

Advantageously, the snap connection of the lid is also equally effective after the container has been opened once, i.e. the snap region and the sealing region are not separated by an area of thinner material that serves as a tamper-proof seal or with which the lid area has to be partially or completely removed or folded over in order to open the container.

The inside lid surface blocking the container opening, which can serve as a stacking surface for containers, is preferably positioned level with or below the bottom edge of the sealing web inside the container. When force is applied, e.g. when stacking containers, the inside surface of the lid can thus be extensively isolated from the sealing web in terms of the forces acting on them.

Furthermore, the inside surface of the lid is preferably located roughly level with, or below, the outer snap edge or a radially projecting reinforcing rib. As the outside of the lid is also supported by the snap edge or a reinforcing rib, the lateral, but particularly the vertical application of force on the lid results in uniform distribution of the force and thus in greater reliability with regard to the leak-proofness of the container.

The sealing region of the sealing web inside the container is located particularly preferably at roughly the height of the outer snap edge or an outer reinforcing rib. In this context, the snap edge of the container is preferably associated with a snap edge of the lid, which merges into the lid area reaching over the top edge of the container without thinning of the material, thus ensuring effective force transmission. In this context, the sealing web is preferably located on the outside, in order to contact the inside of the container when forced is applied, where the inside wall of the container extends essentially vertically or is angled slightly outwards in the region of contact. This achieves a particularly high level of leak-proofness of the lid, as the upper edge region of the container is constrained almost symmetrically by the snap edge of the lid on the outside and by the sealing web on the inside, which exert forces in opposite directions on the container edge.

The inside of the upper container edge can be provided with a bevelled area that serves to facilitate the insertion of the sealing web and can also be designed as a sealing region, e.g. to come into contact with a flexible seal or directly with a sealing region of the lid. The angle between the bevelled top edge and the vertical is acute, i.e. less than 45°.

The lid can have an outward-facing sliding bevel, which can be joined to the top edge of the lid or a region below it. The sliding bevel can be radially flush with the snap edge of the lid on the outside, or extend beyond it, although it preferably extends radially beyond the areas projecting away from the container wall.

The upper edge of the container preferably has a circumferential collar region projecting radially outward and facing downward, on which the snap element is integrally moulded. In this context, a reinforcing rib integrally moulded above the snap element and facing outward can also be integrally moulded on the circumferential container collar, thus also reinforcing it, and/or above the circumferential collar region right on the container wall. Due to the downward-facing collar region, which is spaced apart from the container wall, the snap region is isolated from the sealing region of the sealing web on the inside of the container and on the top edge of the container in terms of the forces acting on them.

The downward-facing, circumferential collar region is preferably joined at the top edge of the container, i.e. at the height of the sealing region or at a distance of a few times the wall thickness, e.g. one or two times, without being restricted to this.

The container preferably has a collar region projecting radially outward and facing downward, which is located below the lid when it is on the container and extends radially to the lid or also beyond it. This circumferential collar region can be integrally moulded on the container wall separately and, in this context, be flush with the bottom edge of the circumferential collar region with the snap edge, or spaced apart from it in terms of height. This circumferential collar region is preferably designed as a continuation of the collar region displaying the snap element, i.e. as a shoulder continuing down and to the outside. The bottom edge of the lid can sit on this collar region with or without pretension, or display a slight amount of play in relation to it, for which purpose a radial constriction for the partial or complete reception of the bottom edge of the lid can be provided.

The lid surface blocking the container opening can be positioned level with or below the inside sealing region, preferably level with or below the snap edge.

A spout can be mounted on the lid, which is preferably located roughly at one-quarter the diameter of the lid surface area, thus resulting in practical handling of the bucket when pouring a liquid.

BRIEF DESCRIPTION OF THE DRAWINGS

An example of the invention is described below and explained on the basis of the figures. The figures show the following.

DETAILED DESCRIPTION OF THE PREFERRED EMBODIMENTS OF THE INVENTION

Figure 1:
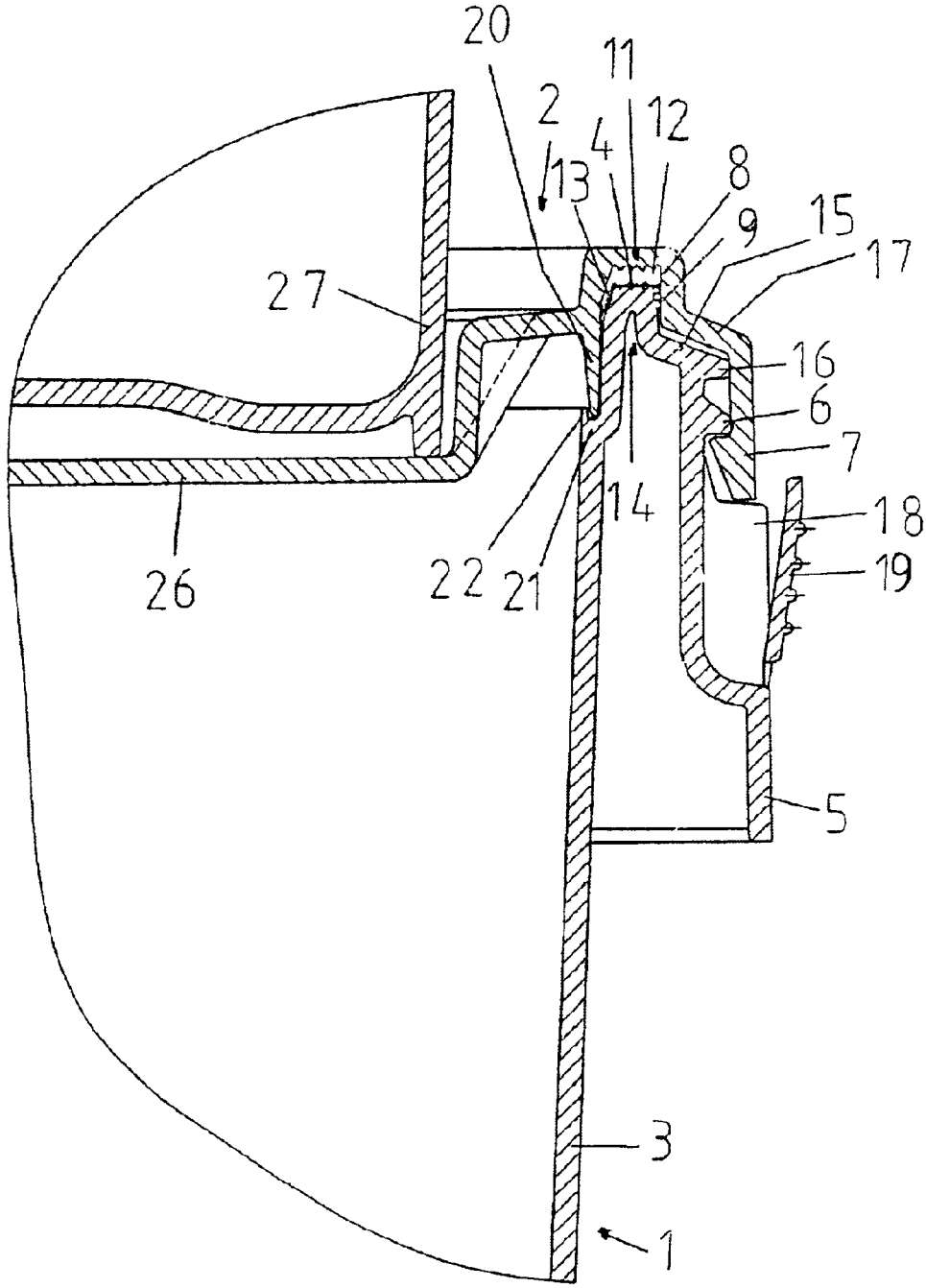
FIG. 1 A partial cross-section of a container with lid according to the invention, with another container stacked on top, FIG. 2 A detail view of a container with lid according to FIG. 1, FIG. 3 A detail cross-section of a container according to FIG. 1, FIG. 4 A top view of a container with lid according to FIG. 1, FIG. 5 A diagram of stacked lids according to FIG. 1, FIG. 6 A detail view of a container with lid according to another configuration, FIG. 7 A diagram of stacked lids according to FIG. 6, FIG. 8 A detail view of a lid according to another configuration, FIG. 9 A detail view of a lid based on a modification of the lid according to FIG. 6.

FIG. 1 shows an injection-moulded plastic bucket 1 with lid 2 snapped on, where a flat area is provided on top edge 4 of outer wall 3 of the bucket. Top edge 4 is connected to a circumferential, radially projecting collar 5, on which an outwardly projecting snap edge 6 is integrally moulded, which is engaged from below by a circumferential snap edge 7 of the lid with a hooked projection.

The region of lid 2 associated with top edge 4 of the bucket is designed in the shape of a groove or channel, where outer flank 8 of groove 34 is in lateral contact with the two, vertically spaced circumferential ribs 9 of the bucket. The radial extension of ribs 9 is considerably less than the wall thickness of the bucket, roughly one-third in this case. Due to the rounded top edge of rib 9 and the small width of the ribs, the lid can easily be pushed onto the bucket, even if sits very tightly against the edge of the bucket. Here, ribs 9 are located at the height of section 12 of the seal, where the lid can rest on the outer wall of the bucket at this height with little or virtually no pretension, even in the absence of these ribs, thus simultaneously ensuring exact positioning of the seal.

A seal made of an elastic and compressible rubber material is injected as a single piece on the horizontal base of the groove in the lid and on radially adjacent inside flank 10. Sealing region 12 associated with inside groove flank 10 is at an angle to the vertical, at an angle of roughly 20° here, where the angle can also taken on values between 5 and 45°, without being restricted to this. When the lid is snapped on, angled section 12 of seal 11 rests against downwardly sloping bevel 13, which is adjacent to the inside of top edge 4 of the bukket (see also FIGS. 2, 3) and whose slope corresponds to that of the contact surface of section 12 of the seal, without being restricted to this. As a result of this special design of the seal, the bucket is securely sealed even when strong forces act on the edge of the bucket and the lid can also be more easily fitted. The section of the lid that surrounds section 12 of the seal radially on the inside is also of bevelled design.

Outer, circumferential collar 5 of the bucket is joined at the height of top edge 4, so that the cavity 14 delimited by collar 5 extends up close to the top edge, i.e. to within about once the wall thickness. The region of top edge 4 of the bukket is thus also designed as a U-shaped, circumferential profile. As a result, the lid can be optimally braced and lateral forces absorbed.

The lid has a circumferential sealing web 20 on the inside relative to seal 11, which only tightly contacts the inside wall of the bucket along part of its height, specifically in the region 20' of the bottom end of the web in this example, which is located roughly at the height of reinforcing rib 16 or the snap edge. Web 20, which essentially projects vertically downward, is located at the height of an inwardly projecting shoulder 21 of the inside wall of the bucket and at a slight vertical distance from it. When slight vertical pressure is applied to the lid, web 20 rests on indentation 21. Indentation 21 is delimited on the inside by a circumferential ridge 22, in place of which individual projections can also be provided, where ridge 22 extends above the bottom edge of web 20 and prevents the inward movement of web 20. Web 20 can also be received in a press fit between ridge 22 and the adjacent, outer wall area of the bucket. Web 20 is angled slightly outward, so that the sealing region of web 20, i.e. the bottom edge of the same (see FIG. 2) would come to rest radially outside the inside wall of the bucket when the lid is removed. In this case, the thickness of the bottom edge roughly corresponds to the rib thicknes preferably more than ¼ of the same, where it is slightly tapered here. As a result, radially pretensioned contact with the inside wall of the container is consistently achieved when A the lid is on.

A circumferential, radially inside edge 23, which slopes slightly down towards the inside or is essentially horizontal, is integrally moulded on web 20 above thy sealing region 20' and below the seal 11 in the region of thy top edge of the container (cf. also FIG. 4), on which inwardly facing bevels 24 or, in areas with a wider edge, essentially vertical wall areas 25 are integrally moulded in segments, which transition into the horizontal lid area 26 at the same height. In this context, wall areas 25, as part of the projections, are integrally moulded on circumferential edge 23 in the circumferential direction of the lid in alternating fashion with bevels 24. Vertically extending side walls 29*a* of the projections integrally moulded on web 20 are thus avoided. In addition, material stresses acting on the two sealing regions are minimised by the vertical spacing of web 20 or when the top side of the projections does not have an edge. Area 26 is located below snap edge 6, where its outside diameter is dimensioned, as shown, such that it is possible to stack buckets. This results in projections with a triangular cross-section that are integrally moulded on a trapezoidal groove open towards the bottom.

The essentially vertical leg of U-shaped top edge 4 transitions towards the outside into a bevel 15, thus forming a stepped shoulder. Snap edge 6 is integrally moulded below this shoulder, where a radial, circumferential reinforcing rib 16 is integrally moulded between the snap edge and the shoulder, at the height of the shoulder here, which, in this example, is flush towards the outside with snap edge 6 and has a corresponding width, i.e. vertical extension. The bottom edge of reinforcing rib 16 is designed to correspond to that of snap edge 6, so that snap edge 7 of the lid can also engage the groove located between edges 6 and 16, to which and the top edge of snap edge 6 also slopes down towards the outside. When completely snapped on, the edge of the lid thus rests against the outer edge of snap edge 6 and/or reinforcing rib 16, so that, together with sealing web 20, force is applied to both sides of the top region of the container. The vertically symmetrical application of force, in particular, results in very good leak-proofness. This is also enhanced by he U-shaped design of the top region of the container, which can be laterally compressed by a tension force. A slight gap can be provided between bevel 15 and sliding bevel 17 of the lid located above it.

Circumferential collar 5 has a circumferential shoulder 18 below snap edge 7 that projects away from snap edge 7 beyond the outer edge of lid 2, where snap edge 7 can rest on shoulder 18 under pretension, or a gap can be provided between the snap edge and the shoulder. Shoulder 18 has a tamper-proof seal 19, after whose removal snap edge 7 can be grasped manually from below and the lid pulled off. It is important to mention here that the lid area between the groove accommodating the seal and the snap edge preferably does not have any significant thinning of the material, so that high stability, and thus high leak-proofness, is ensured between the snap connection and seal 11 or the area of the lid located inside bucket 1.

In order to enable improved force transmission in, and simultaneous stackability of, buckets without lids inside one another, outer wall 3 of the bucket has a taper or angle to the outside of less than 3°, preferably 2°, where smaller angles are also possible. In order to be able to better absorb in the edge region the forces that occur when buckets with lids are stacked, the distance between the side of wall 25 of the projections facing the center of the bucket and the opposite outer wall of the bucket 27 is further designed to allow only slight play, e.g. with a distance of less than 2 mm, preferably 1 mm.

Figure 2:
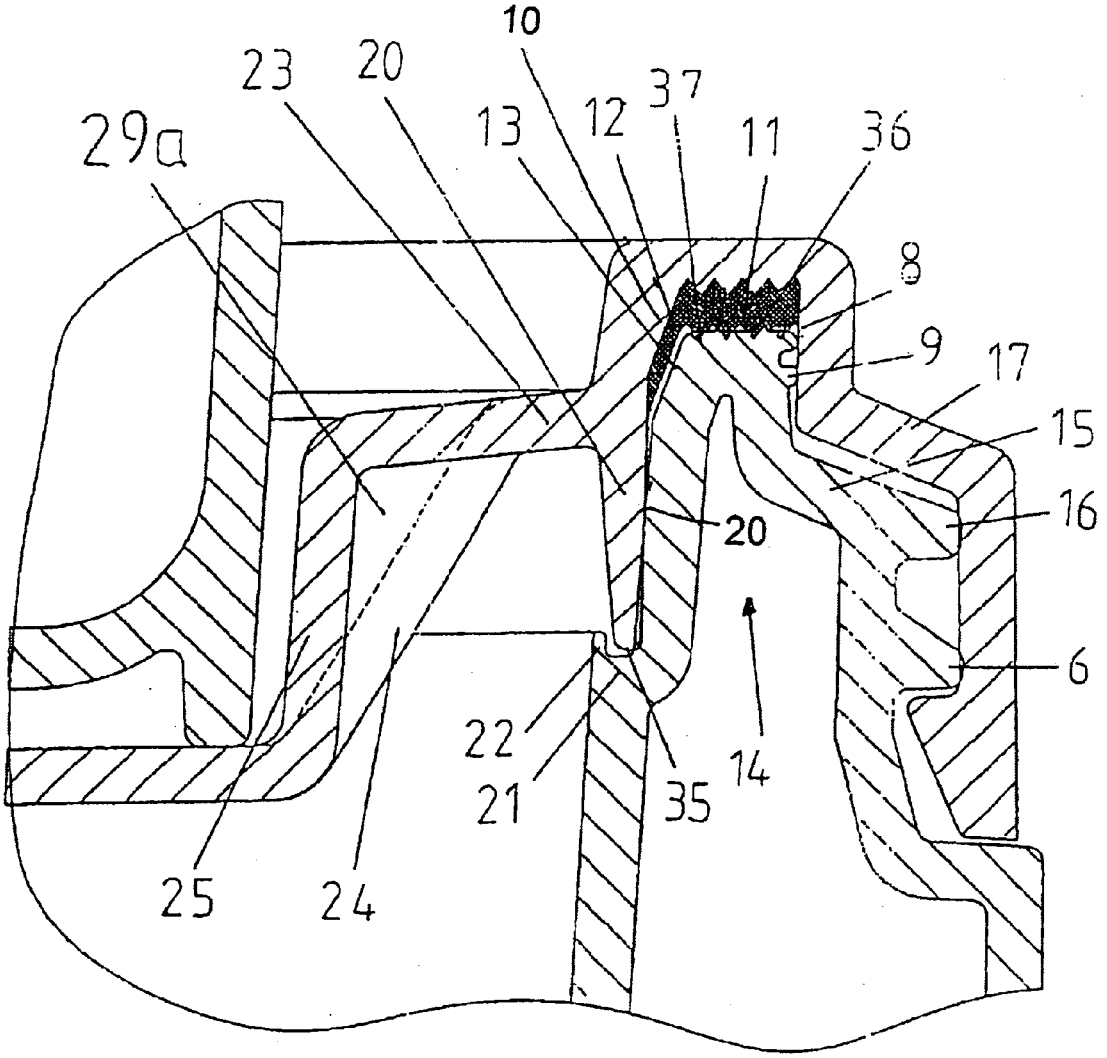
Figure 3:
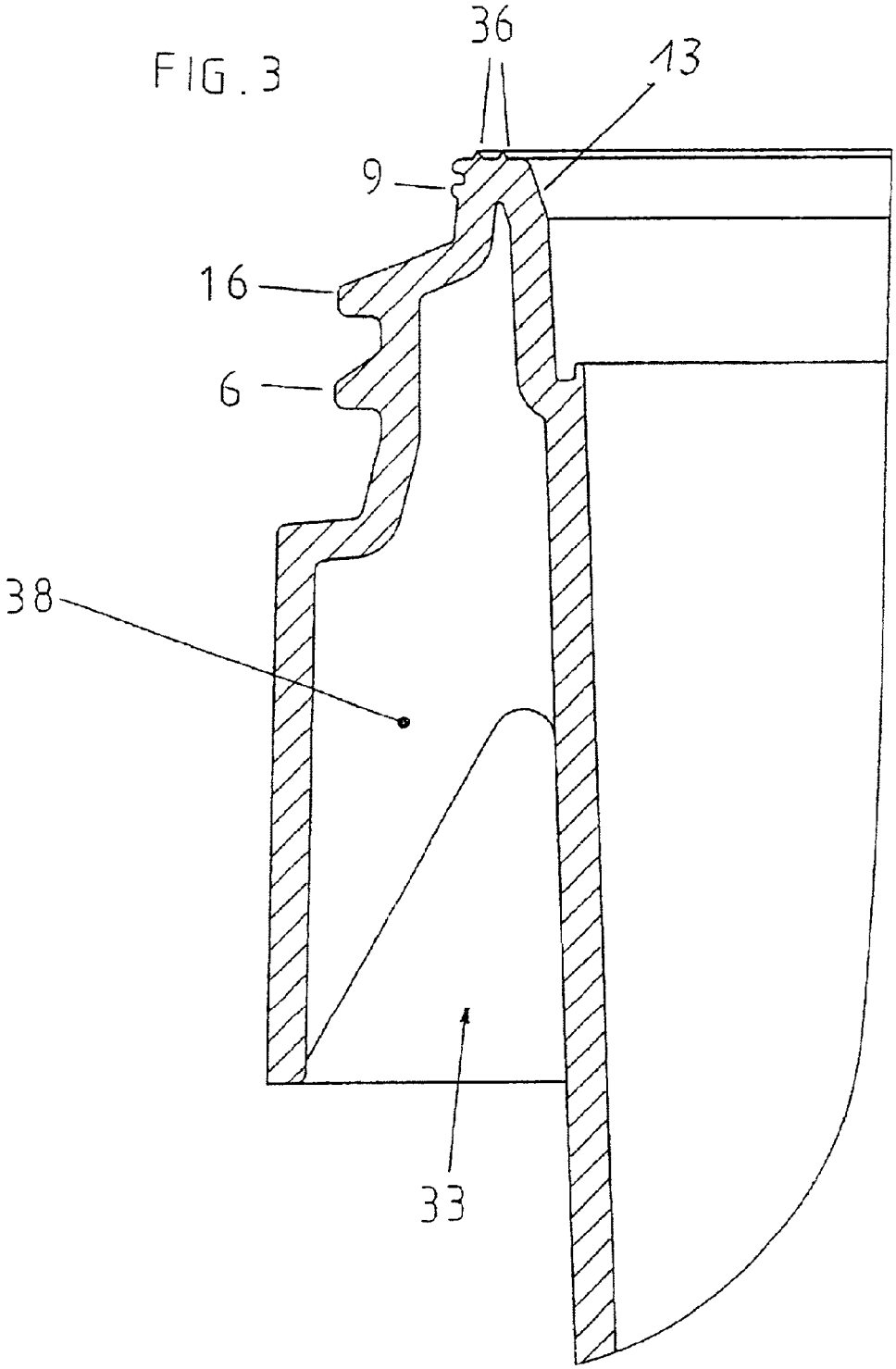

As shown in the enlarged diagrams in FIGS. 2 and 3, top edge 4 of the bucket collar is provided with two, circumferential ribs 36, which engage the teeth on the underside of seal 11 and/or make flat contact next to ribs 36 in the groove formed between them, or outside of this on container edge 4. This incongruent design of the two structures makes the bucket highly leak-proof.

As further illustrated by the Figure, vertical reinforcing ribs 38 that run perpendicular to the outer wall are provided in cavity 14, which have recesses 33 open towards the bottom, where the apex of the recess is offset towards the outer wall of the bucket.

Figure 4:
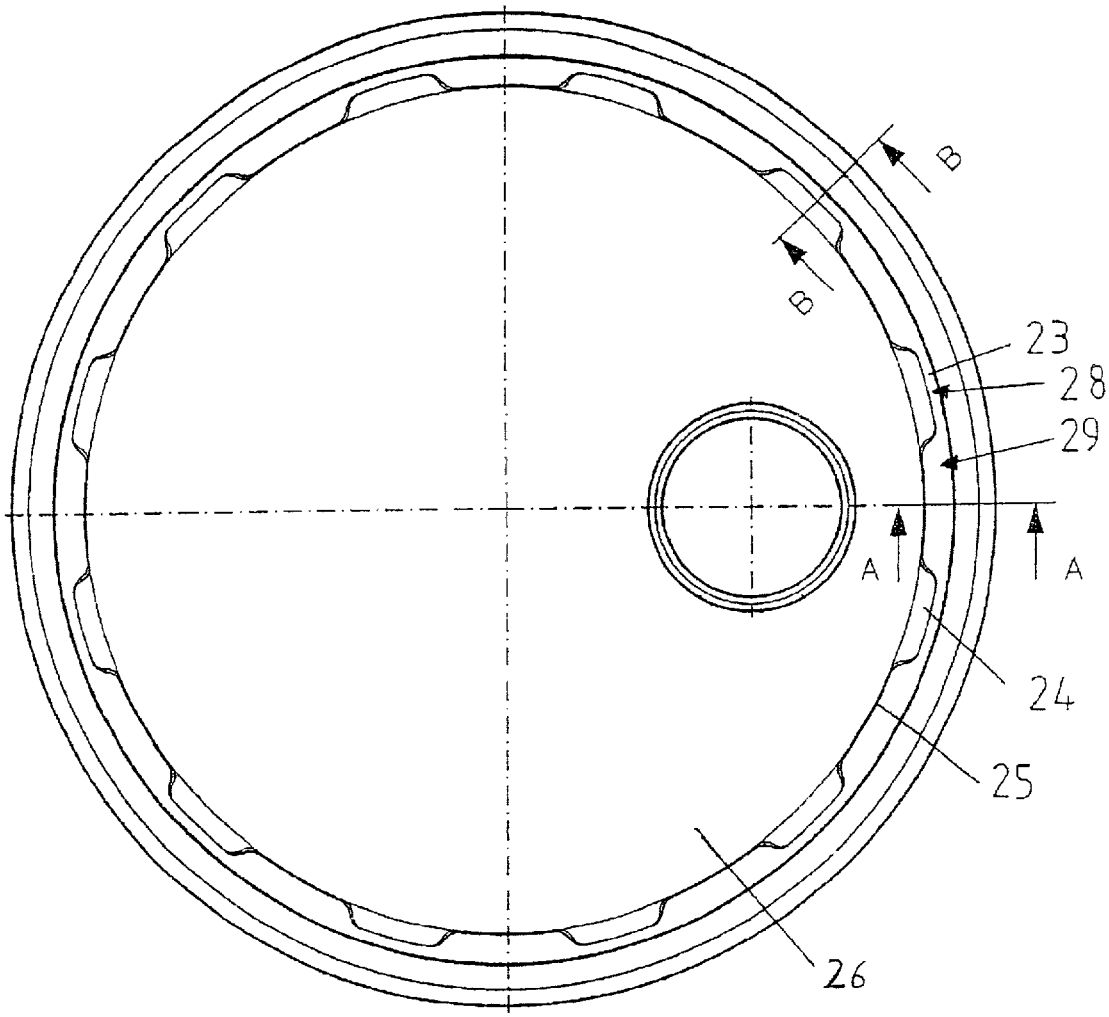

As shown in FIG. 4, circumferential edge 23 of the lid, which is located on the inside of bucket wall 3, is provided with segments 28, 29 of different radial width, this resulting in an effective reinforcing profile, in order to absorb forces on the sealing region of web 20 or seal 11. According to the example, the circumferential extension of segments 28, 29 is a multiple of their width. Bevels 24 and vertical wall areas 25 end at the same distance from the main axis of the bucket, where areas 30 delimiting bevel 24 on the side are inclined towards the periphery of the lid. Areas 25, 29 and 29*a* thus border projections 25*a*.

A closable spout, which is located at about one-quarter the diameter of the bucket, is located in the central area 26 of the lid.

Figure 5:
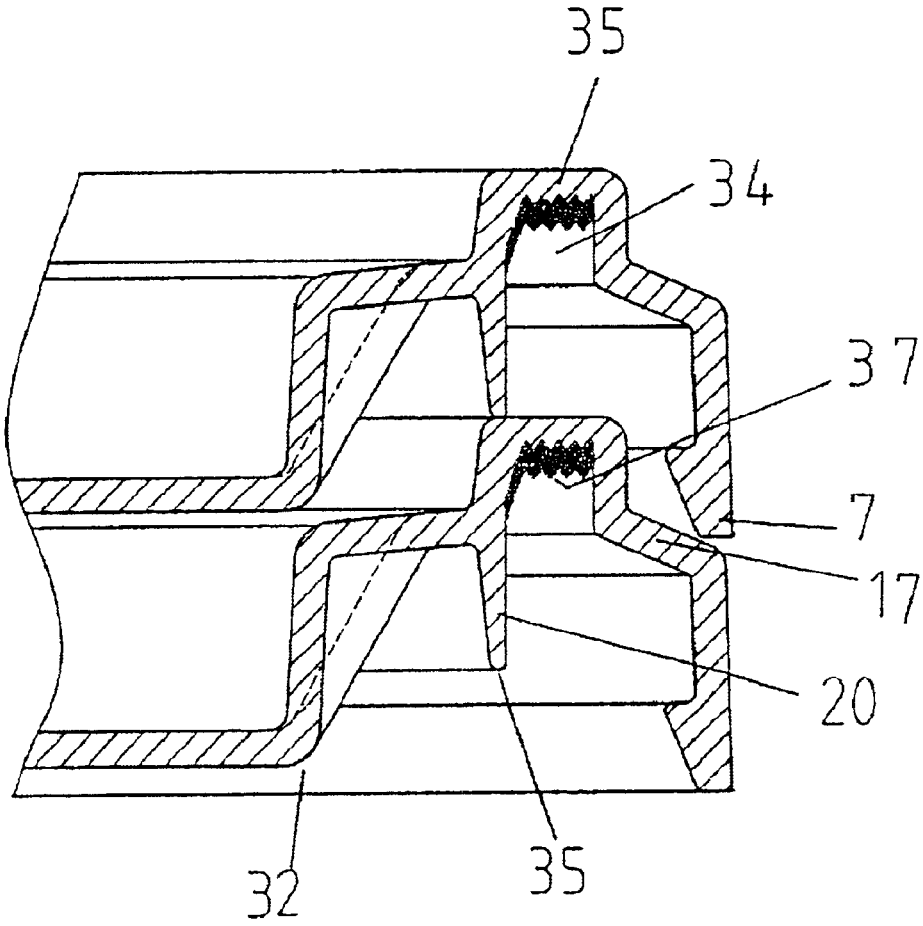
Figure 6:
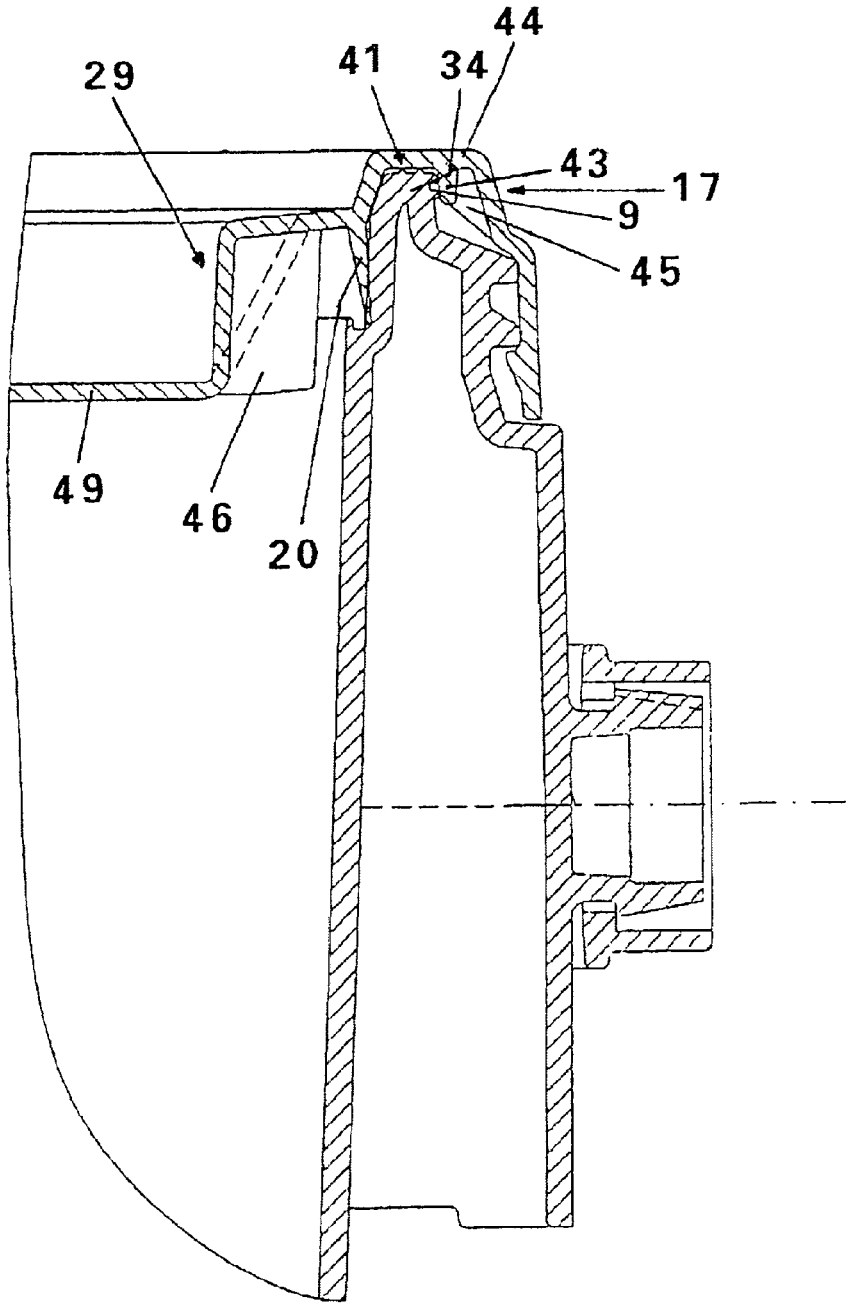

As shown in the stacking diagram in FIG. 5, the bottom edge of snap edge 7 of the lid rests on sliding bevel 17, and bottom edge 35 of sealing web 20 on horizontal leg 31 of groove 34 holding seal 11. Bottom edge 32 of box-shaped projection 25*a* can alternatively or additionally rest on the top edge of the projection of the lid below. As shown in FIGS. 2 and 6, the bottom edge of the sealing web forms the sealing region with the maximum sealing effect relative to the inside wall of the container. In this context, the region of the sealing web on the circumferential edge 23 (the same would apply to other integrally moulded areas, such as projections integrally moulded right on the sealing web) can provide no sealing effect, or only a secondary sealing effect, although it can also provide a significant or high sealing effect if appropriate.

FIG. 6 shows another practical example, in which segments 29 with essentially vertical reinforcing ribs 46 are provided on the inside of the lid, which are connected to the outer, essentially vertical and essentially horizontal areas of projecting segments 29 and end in front of circumferential sealing web 20. The distance to sealing web 20 can also be relatively small, e.g. in the region of the wall thickness of rib 46 or less. The reinforcing ribs can also extend up to sealing web 20, where they preferably do not, however, contact the sealing edge in linear fashion, in order to avoid leaks due to shrinkage, particularly not at the height of the sealing contact area of the sealing rib on the inside wall of the container. Reinforcing ribs 45 of such design can also be correspondingly provided on an inside, circumferential edge of the lid, which is not divided into projecting and receding areas. Ribs 46 are flush with the bottom edge of the lid region. They can also support lid area 26 if necessary.

Sealing ribs 41, which are made of the container material, are also provided on the top edge of the container, where the groove 34 that receives top edge 40 of the container is of plane design. Of course, sealing ribs can also be provided only on the contact area of the lid, or on the underside of the lid and the top edge of the container, where the ribs can rest against one another laterally. Sealing ribs 41 are made of the same material as the container and are integrally moulded in one piece. Here, top edge 40 of the container is surrounded on the outside by a circumferential, downwardly projecting web 43, which is in close contact with outwardly projecting, circumferential ribs 9 of the container.

Horizontal lid area 44, which forms the base of the groove, extends radially outward beyond web 43, so that sliding bevel 17 is steeper than in the previous practical examples. Reinforcing ribs 45 can be provided between web 43 and sliding bevel 17.

Areas 13*a*, 13*b* of the lid and the container, which are radially adjacent to the inside of the sealing region of the top edge of the container, slope down towards the inside of the container, with a slope of more than 60° in this case, where the lid and the container can have slight play or also be in contact with one another.

Otherwise, the container with lid according to this practical example has the features of the first practical example, which is referred to in this context.

As shown in the stacking diagram in FIG. 7, reinforcing ribs 46 can simultaneously serve the purpose of providing support on the lid below and rest in linear or punctiform fashion on the top side of inside projections 29 or the circumferential edges. In addition, the lid is supported on the lid below by web 47, projecting downwards below the snap edge, resting on circumferential shoulder 48 surrounding sliding bevel 17. In this context, sealing web 20 is at a distance from the adjacent lid and can, if necessary, also rest on it.

Of course, the stacking pattern in the diagram can also be realised for other configurations of the container or lid, particularly other configurations of the sealing region on the top edge of the container.

Figure 8:
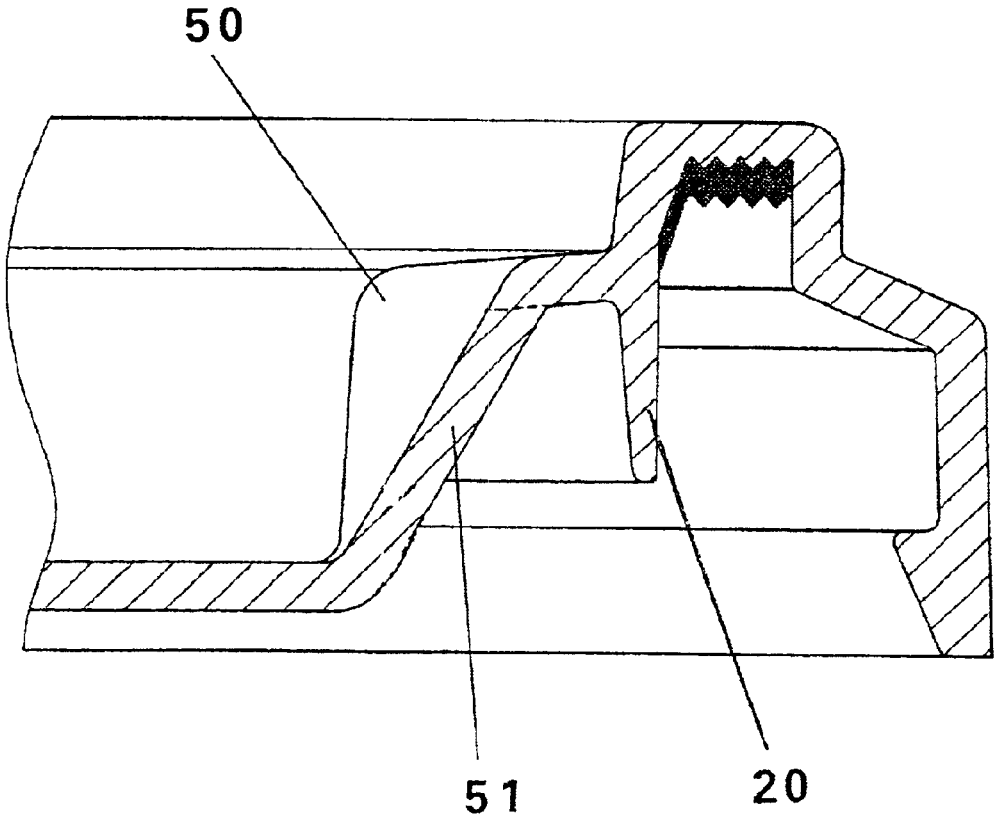

FIG. 8 shows another configuration, in which at least one projection 50 is integrally moulded on the top side of an area 51 extending radially inwards from the sealing web and sloping down towards the inside of the container. In this case, area 51 is a circumferential edge. Projection 50 is designed in the shape of a web here, where a number of webs are integrally moulded on the circumferential area. Area 51, which slopes down towards the inside of the container can be directly joined to sealing web 20. The radially inward flank of the projection can also be sloped.

Figure 7:
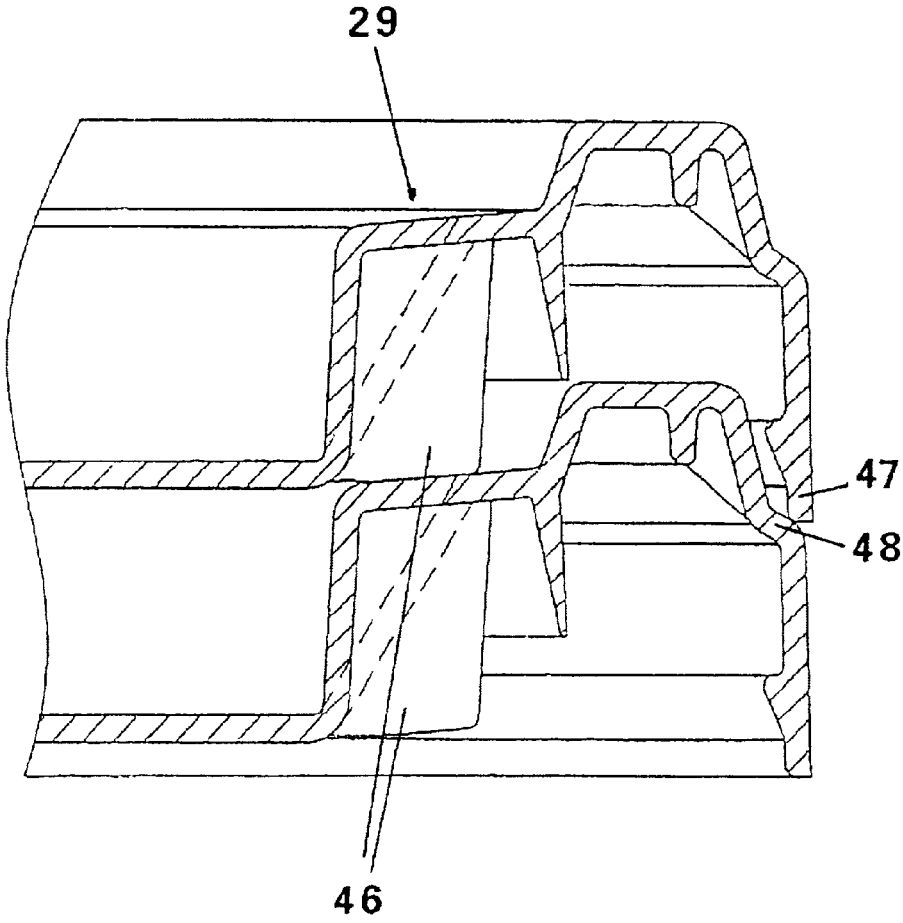
Figure 9:
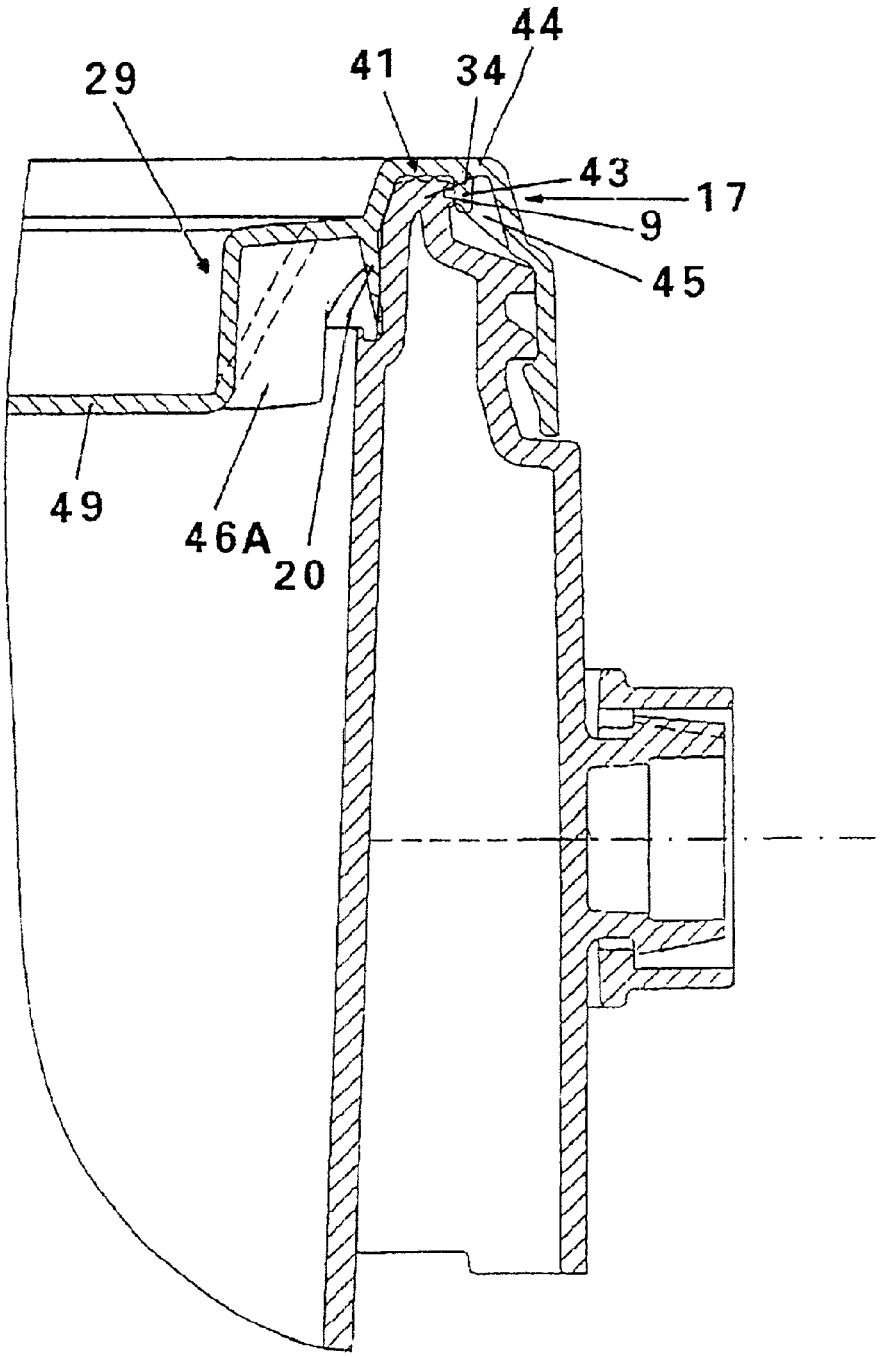

FIG. 9 shows a modification of a lid according to FIGS. 6 and 7, in which reinforcing ribs 46*a* extend all the way to sealing web 20 and have a section integrally moulded on it, the height of which is small relative to the height of the sealing web itself.

| List of reference numbers | |
|---|---|
| 1 | Bucket |
| 2 | Lid |
| 3 | Outer wall |
| 4 | Top edge |
| 5 | Collar |
| 6, 7 | Snap edge |
| 8 | Outer flank |
| 9 | Rib |
| 10 | Flank |
| 11 | Seal |
| 12 | Vertical section |
| 13 | Bevel |
| 14 | Cavity |
| 15 | Bevel |
| 16 | Reinforcing edge |
| 17 | Sliding bevel |
| 18 | Shoulder |
| 19 | Tamper-proof seal |
| 20 | Sealing web |
| 21 | Indentation |
| 22 | Ridge |
| 23, 24 | Bevel |
| 25 | Wall |
| 25a | Projection |
| 26 | Area |
| 27 | Outer wall |
| 28, 29 | Segment |
| 29a | Side wall |
| 30 | Area |
| 31 | Horizontal leg |
| 32 | Bottom edge |
| 33 | Recess |
| 34 | Groove |
| 35 | Bottom edge |
| 36, 37, 38 | Rib |
| 40 | Top edge |
| 41 | Sealing rib |
| 43 | Web |
| 44 | Lid area |
| 45, 46 | Reinforcing rib |
| 46a | Reinforcing rib |
| 47 | Web |
| 48 | Shoulder |
| 49 | Inside lid area |
| 50 | Projection |
| 51 | Sloping area |

What is claimed is:

1. A plastic container with a snap lid, the container having a top edge region, an inside and an outer snap edge provided on the top edge region of the container for the lid to snap onto, the lid having a circumferential sealing web projecting downwards that contacts the inside of the container providing a sealing region, at least one projection extending in an essentially radial and essentially vertical direction provided on the lid radially inside the sealing web, wherein a vertical extension of an area of the at least one projection adjacent to the sealing web is smaller than a total vertical extension of the at least one projection, wherein the sealing region of the sealing web on the inside of the container is at level with the outer snap edge or at least one radially outward protruding reinforcing rib is integrally molded on the top edge region of the container and the sealing region of the sealing web is at level or roughly level with the radially outward protruding reinforcing rib of the container.

2. The container according to claim 1, wherein areas of the at least one projection adjacent to the sealing web are provided which are formed walls extending perpendicularly to the sealing webs the vertical extension of the walls adjacent to the sealing web being smaller than the total vertical extension.

3. The container according to claim 1, wherein the at least one projection is spaced radially apart from the sealing web located on the inside of the container.

4. Container as per claim 3, characterized in that the at least one projection is located on an inside circumferential edge integrally moulded on the sealing web an extends radially inward from the circumferential edge.

5. Container as per claim 4, characterized in that the circumferential edge extend in the radial direction over one or more times the wall thickness from the inside of the sealing web and the at least of one projection is located radially inside relative to the circumferential edge.

6. The container according to claim 1, wherein an area of the at least one projection integrally moulded on the sealing web is spaced apart from an area of the sealing web that provides the greatest sealing effect.

7. The container according to claim 1, wherein the sealing region of the sealing web is along at least a portion of the vertical height of the projection.

8. The container according to claim 1, wherein the at least one projection is integrally moulded on the lid at a height of a top aide of an area extending radially inwards from the sealing web and sloping down towards the inside of the container.

9. The container according to claim 1, wherein an additional circumferential sealing region is provided wherein areas of the projection of the lid integrally moulded on the sealing web and extending radially inward are spaced vertically apart from the additional sealing region.

10. Container as per claim 9, characterized in that, the additional circumferential sealing region in arranged in the region of the top edge of the container.

11. The container according to claim 1, wherein an indentation is formed in the inside wall of the container below the sealing web, on which a lower, free end of the sealing web can rest.

12. Container as per claim 11, characterized in that an area projecting upwards beyond the bottom edge of the web is provided on the inside wall of the container, which lies radially inward relative to the circumferential sealing web.

13. Container as per claim 1, characterized in that the inside lid surface on the inside of the container is positioned at a level not higher than the bottom edge of the sealing web.

14. The container according to claim 1, wherein a further sealing region between a top edge of the container and the lid is provided with a circumferential seal made of a material of greater elasticity than that of the container and the lid.

15. The container according to claim 1, wherein the container has a main axis and that an area which slopes down towards the inside wall of the container and is at an acute angle to the main axis of the container is provided radially inward on the top edge of a container.

16. Container as per claim 14 characterized in that the container has a main axis and that the seal is provided with an area which slopes down towards the inside wall of the container and is at an acute angle to the main axis of the container is provided radially inward on the top edge of the container.

17. The container according to claim 1, wherein at least one contact surface for lateral contact with the lid, which projects radially outward, is integrally moulded on the area adjacent to a top edge of the container on the outside.

18. The container according to claim 1, wherein the outside of the top edge of the container has a downward-facing circumferential collar region, which is joined in the top edge region of the container.

19. A plastic container with a snap lid, the container having a top edge region, an inside and an outer snap edge provided on the top edge region of the container for the lid to snap onto, the lid having a circumferential sealing web projecting downwards that contacts the inside of the container providing a sealing region, at least one projection extending in an essentially radial and essentially vertical direction provided on the lid radially inside the sealing web, wherein a vertical extension of an area of the at least one projection adjacent to the sealing web is smaller than a total vertical extension of the at least one projection, wherein the at least one projection is spaced radially apart from the sealing web wherein the at least one projection is located on an inside circumferential edge integrally moulded on the sealing web and extends radially inward from the circumferential edge, and wherein a sealing region of the sealing web on the inside of the container is at level or roughly level with the outer snap edge or at least one radially outward protruding reinforcing rib is integrally molded on the top edge region of the container and the sealing region of the sealing web is at level or roughly level with the radially outward protruding reinforcing rib of the container.

20. A plastic container with a snap lid, the container having a top edge region, an inside and an outer snap edge provided on the top edge region of the container for the lid to snap onto, the lid having a circumferential sealing web projecting downwards that contacts the inside of the container providing a sealing region, at least one projection extending in an essentially radial and essentially vertical direction provided on the lid radially inside the sealing web, wherein a vertical extension of an area of the at least one projection adjacent to the sealing web is smaller than a total vertical extension of the at least one projection, wherein the at least one projection is spaced radially apart from the sealing web, wherein the at least one projection is located on an inside circumferential edge integrally moulded on the sealing web and extends radially inward from the circumferential edge, and wherein the outside of the top edge region of the container has a radially outward projecting and at least substantially vertical downward-facing circumferential collar region, which is joined in the top edge region of the container, the snap edge is molded spaced from an upper end and from an lower end of the collar region at the at least substantially vertical downward-facing circumferential collar region and the snap edge is arranged at the level of the at least one projection.

21. A plastic container with a snap lid, the container having a top edge region, an inside and an outer snap edge provided on the top edge region of the container for the lid to snap onto, the lid having a circumferential sealing web projecting downwards that contacts the inside of the container providing a sealing region, at least one projection extending in an essentially radial and essentially vertical direction provided on the lid radially inside the sealing web, wherein a vertical extension of an area of the at least one projection adjacent to the sealing web is smaller than a total vertical extension of the at least one projection, (1) wherein the at least one projection is spaced radially apart from the sealing web, (1a) the sealing region of the sealing web on the inside of the container is at least or roughly level with the outer snap edge, or (1b) at least one radially outward protruding reinforcing rib is integrally molded on the top edge region of the container and the sealing region of the sealing web is at level or roughly level with the radially outward protruding reinforcing rib of the container, or (1c) the outside of the top edge region of the container has a radially outward projecting and at least substantially vertical downward-facing circumferential collar region, which is joined in the top edge region of the container, the snap edge is molded spaced from an upper end and from an lower end of the collar region at the at least substantially vertical downward-facing circumferential collar region and the snap edge is arranged at the level of the at least one projection.

(2) and wherein the snap edge or the reinforcing rib is arranged vertically below the area of the at least one projection adjacent to the sealing web, or is arranged vertically below an inside circumferential edge integrally moulded on the sealing web and extending radially inward from the circumferential edge, at which the at least one projection is located on.

22. A plastic container with a snap lid, the container having a top edge region, an inside and an outer snap edge provided on the top edge region of the container for the lid to snap onto, the lid having a circumferential sealing web projecting downwards that contacts the inside of the container providing a sealing region, at least one projection extending in an essentially radial and essentially vertical direction provided on the lid radially inside the sealing web, wherein, a vertical extension of an area of the at least one projection adjacent to the sealing web is smaller than a total vertical extension of the at least one projection, wherein the outside of the top edge region of the container has a radially outward projecting and at least substantially vertical downward-facing circumferential collar region, which is joined in the top edge region of the container, the snap edge is molded at the at least substantially vertically downward-facing collar region, wherein at least one radially projecting reinforcing rib is integrally molded on the at least substantially vertically downward-facing collar region or between the snap edge and the top edge region of the container, and wherein the sealing region of the sealing web on the inside of the container is at level or roughly level with the outer snap edge, or at least one radially outward projecting reinforcing rib being integrally molded on the top edge region of the container is at level or roughly level with the sealing region.

* * * * *